US005367719A

United States Patent [19]

Mermelstein

[11] Patent Number: 5,367,719

[45] **Date of Patent: * Nov. 29, 1994**

[54] TANK HAVING FLUID FLOW CONTROLLING APPARATUS

[75] Inventor: Seymour Mermelstein, Newton, Mass.

[73] Assignee: SwimEx Systems Inc., Warren, R.I.

[ * ] Notice: The portion of the term of this patent subsequent to Apr. 9, 2008 has been disclaimed.

[21] Appl. No.: 4,232

[22] Filed: Jan. 7, 1987

Related U.S. Application Data

[63] Continuation of Ser. No. 774,541, Sep. 10, 1985, abandoned.

[51] Int. Cl.[5] ..... E04H 4/12

[52] U.S. Cl. ..... 4/488; 4/904

[58] Field of Search ..... 4/488, 489, 491, 492, 4/496, 904

[56] References Cited

U.S. PATENT DOCUMENTS

| | | | |
|---|---|---|---|
| 930,613 | 8/1909 | Pressey | 446/153 |
| 1,331,270 | 2/1920 | Lippincott | 4/496 X |
| 1,630,797 | 5/1927 | Marwick | 4/496 X |
| 1,731,554 | 10/1929 | Wheeler | 4/496 X |
| 2,035,835 | 3/1936 | Raber | 4/488 |
| 3,203,352 | 8/1965 | Schafranek | 417/423.5 X |

FOREIGN PATENT DOCUMENTS

| | | | |
|---|---|---|---|
| 229440 | 12/1910 | Germany | 4/488 |
| 2222594 | 11/1973 | Germany | 4/491 |

*Primary Examiner*—Charles E. Phillips
*Assistant Examiner*—D. Jones
*Attorney, Agent, or Firm*—Fish & Richardson

[57] ABSTRACT

A swim tank slightly longer than a human and slightly wider than the maximum spread between fingertips is divided into upper and lower channels by polycarbonate or members extending across the width of the tank and having a rectangular outlet at the top front through which water is expelled. A vaned wheel at the rear is driven by an induction motor from a power source of controlled frequency.

16 Claims, 3 Drawing Sheets

TANK HAVING FLUID FLOW CONTROLLING APPARATUS

This application is a continuation of Ser. No. 06/774,541, filed Sep. 10, 1985, now abandoned.

The present invention relates in general to flow controlling and more particularly concerns novel apparatus and techniques for controlling fluid flow, such as water in a tank, to establish a range of relative velocities between the flowing fluid and an object in it, such as a swimmer, while the object remains substantially stationary relative to earth. An embodiment of the invention provides a compact environment for a swimmer to attain all the exercise and fun of swimming at the swimmer's pace. Thus, the invention may be said to provide the environment of a swimming pool of infinite length in a structure slightly longer and wider than a swimmer while providing a form of exercise that cannot be achieved in a conventional bounded swimming pool with stationary water.

It is known in the prior art to provide spas or tubs that create a flow through jets to allow a swimmer to swim upstream against the water jets. A difficulty with these prior art structures is that the jets create a turbulent current that often exerts sideward and up and downward forces on the swimmer and makes swimming against the longitudinal component of the current difficult. Examples of these prior art devices are the swimjet spa commercially available from Curtis Plastics of Huntington Beach, Calif., and the model AP-S1-SL3 swim spa available from Weidemann Industries, Inc. of Muscatine, Iowa.

A search of subclasses 71 and 72 of class 272 and subclasses 488, 491 and 509 of class 4 uncovered U.S. Pat. Nos. 520,342, 1,285,259, 1,331,270, 1,630,797, 1,796,291, 1,992,891, 2,035,835 and 3,534,413.

U.S. Pat No. 2,035,835 discloses confined flow channels in a tank; however, this patent does not disclose water driving means truly transverse to the length of the channel; therefore, the disclosed structure would create undesired turbulence. Furthermore, this patent discloses straight end walls having a tendency to create a head which would then empty wastefully into the swim channel and turbulently induce air and noise instead of contributing to establishing the desired current.

U.S. Pat. Nos. 1,285,259 and 1,331,270 disclose paddle wheels used for surface movement only and could not establish a current along the length of the channel having negligible velocity gradient along the width.

It is an important object of this invention to provide improved apparatus and techniques for flow controlling.

According to the invention, there is tank means for containing a fluid, such as water. The tank means includes means defining upper and lower generally parallel channels in the tank means for accommodating fluid flow in opposed upper and lower flow directions, respectively. Preferably, the height of the upper channel is significantly greater than that of the lower channel. There is drive means, preferably at one end of the tank means, for driving the fluid to flow in said upper and lower channels in said opposed upper and lower directions with the flow at the top of the upper channel having negligible velocity gradient along substantially the entire width of the upper channel. Preferably the drive means comprises a vaned rotor at one end of the tank means that rotates to cause the fluid flow. In a specific form of the invention the vaned rotor comprises three to six vanes extending substantially across the entire width of the tank means of diameter slightly less than the height of the tank means. Preferably the other end of the tank means is formed with a curved channel having a generally rectangular outlet at the top of the upper channel for expelling fluid at substantially uniform velocity across the width of the tank means. Preferably, there is baffle means at the end of the upper channel for controlling backup wave severity and helping prevent swimmers from engaging the vanes while moving. Preferably, the vaned rotor is driven by an induction motor of electronically controlled frequency that controls the speed of rotation from substantially zero to maximum to allow a swimmer to set the current speed at any value from zero to maximum.

Numerous other features, objects and advantages of the invention will become apparent from the following specification when read in connection with the accompanying drawing in which.

Figure 1:
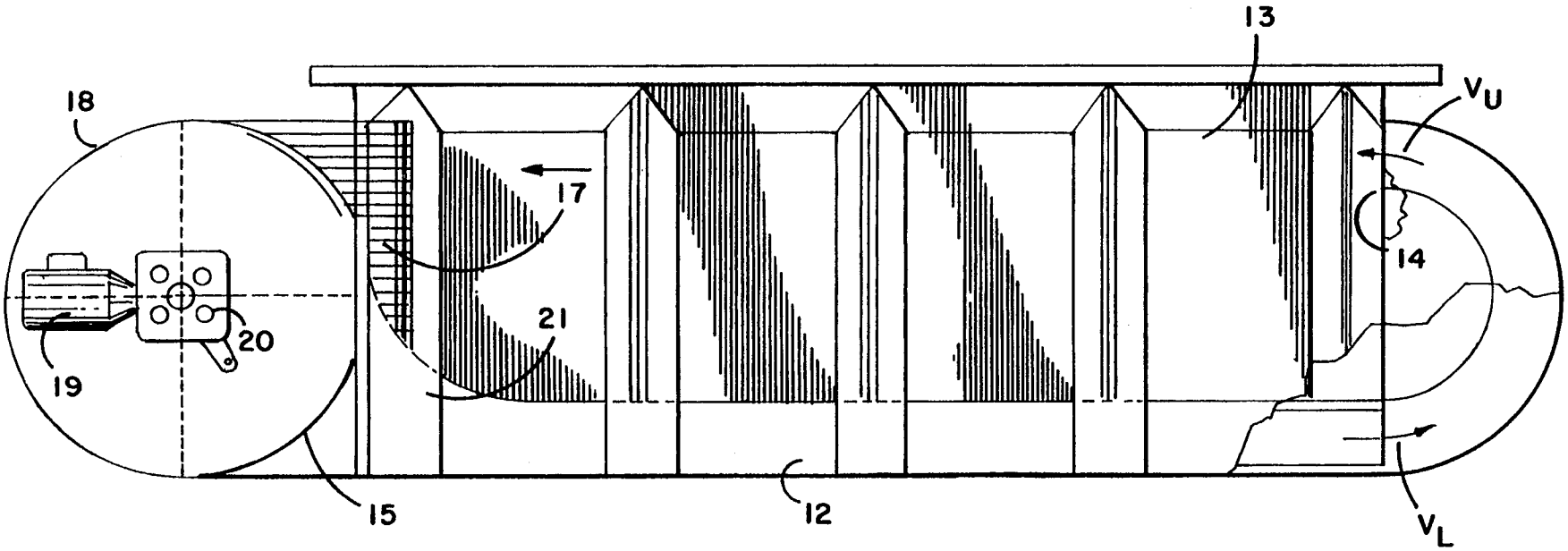
FIGS. 1 and 2 are pictorial side and perspective representations respectively of an actual working embodiment of the invention.
Figure 2:
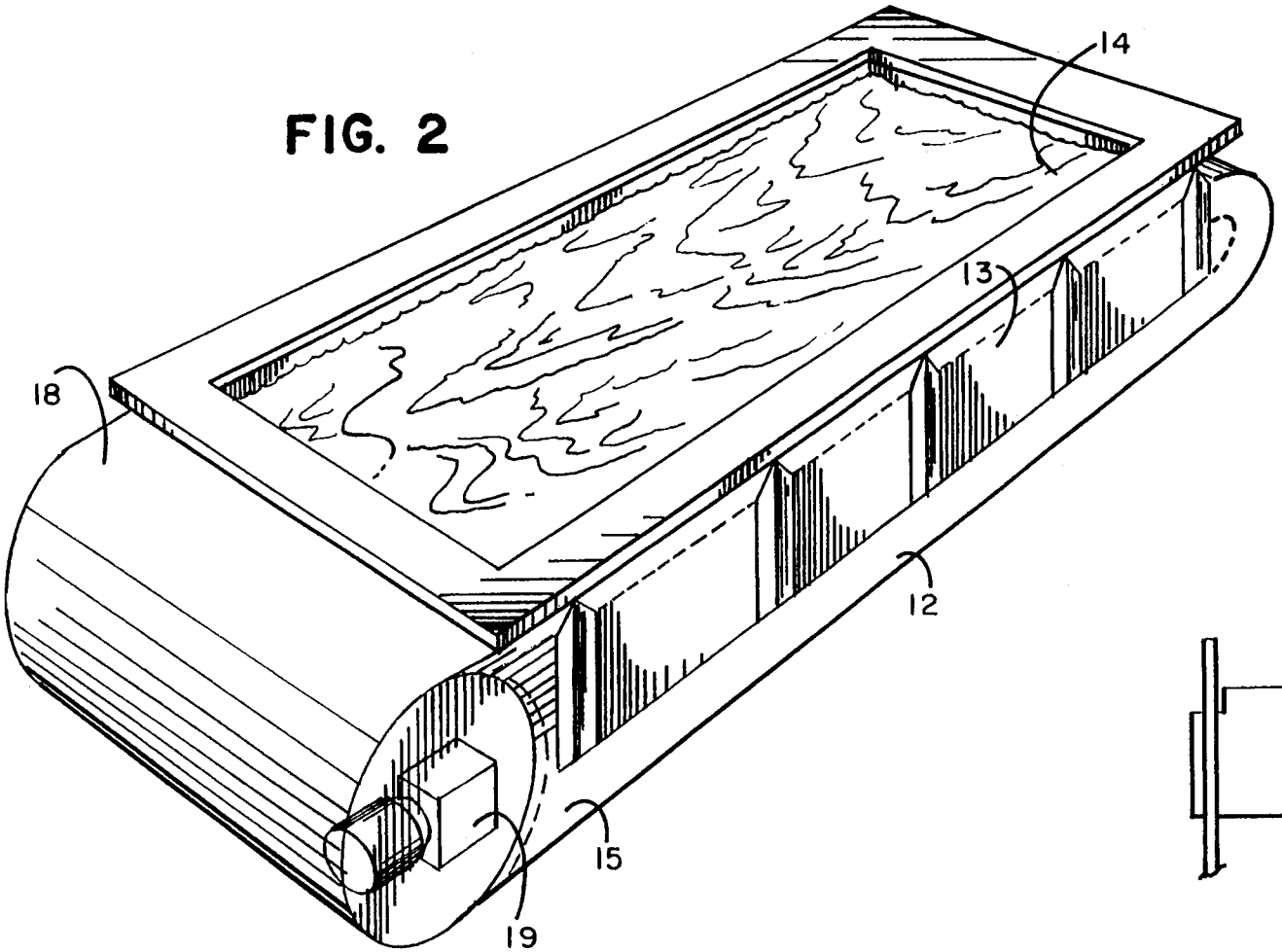

With reference now to the drawing and more particularly FIGS. 1 and 2 thereof, there are shown side and perspective pictorial views respectively of an embodiment of the invention. A tank 11, slightly longer than a swimmer, typically 9–12 feet long and slightly wider than the maximum spread between fingertips of a swimmer, typically 5–7 feet wide, is filled with water. Tank 11 includes a number of plastic (polypropylene and polycarbonate) panels extending the width of the tank curved as shown for defining a lower channel 12 with water moving forward, as indicated by the vector designated $V_L$, and an upper channel 13 with water flowing rearward, as indicated by the velocity vector designated $V_U$. The upper portion of the curved conduit is formed with a rectangular baffled opening 14 through which water is expelled to the upper channel 13 to create a flow of substantially uniform velocity along the width of tank 11 at the top of the tank. The top of opening 14 is below the top of tank 11 so that when the tank is filled with water as shown in FIG. 2, the top of opening 14 is below the top of the water.

A vaned rotor 15 is rotatably supported at the rear of tank 11 and rotates counterclockwise as shown in FIG. 1 to draw water through baffle 17 and propel the water into the tapered inlet 21 at the rear end of lower channel 12. Vaned rotor 15 is shrouded closed by shroud 18 at the rear semicircular cross section and open shrouded by baffle 17 along most of the front. Rotation of vaned rotor 15 thus creates the indicated current flow.

In a specific embodiment of the invention, there are six vanes on vaned rotor 15 equiangularly spaced about the rotor axis, driven by a five horsepower three-phase induction motor through a conventional gear reduction transmission, such as a worm gear reducer 20. Typically, an 1160 rpm motor 19 drives vaned rotor 15 through a 15:1 gear ratio-reducer 20 that is shaft mounted. The motor is energized by an electronic inverter that provides three-phase power at controlled frequency to allow the vaned rotor to rotate from 0 to 77 rpm depending on the energizing frequency. This power source is typically a commercially available Graham inverter whose frequency is controlled by a potentiometer energized by a 24 volt a-c supply that minimizes the danger of electrical shock to a swimmer.

Figure 3:
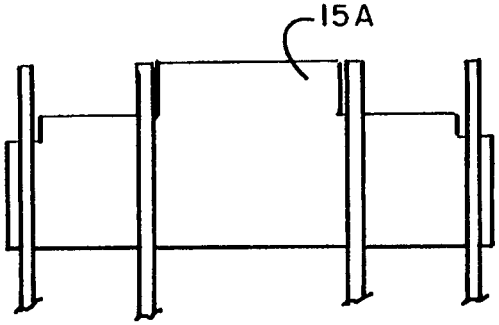
FIG. 3 is a plan view of an exemplary vane on the vaned rotor.

Referring to FIG. 3, there is shown a plan view of a vane 15A.

In a specific embodiment of the invention a five-horsepower Leroy-Somers Power Block induction motor having a nominal rpm of 1160 when energized by 220 volts three-phase energy drove vaned rotor 15 through a belt drive with a 1.8:1 reduction and a driving gear on the input shaft of a 10:1 Boston worm gear reducer with the output shaft of the latter coupled through a chain coupling to the main shaft of vaned rotor 15 controllable from 0–64 RPM. A Graham inverter energized by 220 volts single-phase at a maximum of 35 amperes provided three-phase output power to the induction motor at a controllable frequency from 0 to 120 Hz with a maximum current of 15 amperes per leg. Alternatively, other driving means may be provided. For example, vaned rotor 15 may be driven by water jets coupled to the shaft with driving water being furnished to the shaft through a suitable coupling from a pump supplying sufficient energy to drive vaned rotor 15 with sufficient rotational velocity to achieve the desired current, typically 0 to 64 RPM for the specific embodiment described having six vanes. The jets may be located on the tips of the vanes perpendicular to the vane surfaces. It is preferable that the shroud 18 be as close to the vane ends as practical without introducing friction therebetween so as to optimize efficient transfer of power from the rotating vanes to the water. Preferably the angle between vanes corresponds to the angle subtended by a vertical plane passing through the axis of vaned rotor 15 and a plane passing through that axis and an extension of the top of lower channel 12 and a plane tangential to vaned rotor 15 at the forward side of vaned rotor 15. Tapered inlet 21 comprises entry deflector means angled upward from the lower channel 12 toward the vaned rotor 15 allows fluid in the form of an escape flume flowing outside the perimeter of vaned rotor 15 having an upward component to be captured and guided forward into and along lower channel 12.

The outer tank is preferably made of stainless steel, and the baffles and channel dividers preferably made of polypropylene plastic. Other materials may be used.

For example, the tank may be inground or above ground and made of concrete or vinyl-lines wood or metal. The invention may be located in a small portion of a conventional pool, such as in a corner at the shallow end using two walls of the pool and walls made of plastic or other material. Preferably, the power source for driving paddle wheel 15 is water jets when located in an inground tank or pool.

Conventional pool filter, chlorinating or other purifying equipment and techniques may be used to keep the water clean and free of bacteria. Conventional heating equipment may be used to heat the water, such as a heat pump or gas or oil heater.

Having described the structure, it is appropriate to discuss principles of operation and some modifications to the structure described above that may be desirable.

The preferred embodiment of the invention comprises a transverse vane pump with working clearances to eliminate wear problems between the shroud and vanes, the rotor axis being substantially parallel to the width dimension of the tank. The vaned rotor is of diameter about equal to the depth of the tank.

While the vane rotor could be constructed with vanes equiangularly disposed about a central shaft or tube embracing the rotor axis to define sectoral chambers isolated from each other by the vanes, it is more practical to secure the vanes to the rotor shaft with clamps with a gap between to allow access to the clamps which secure the vanes to the rotor shaft. The migration of water about the rotor shaft through these gaps is relatively insignificant because the outside diameter of the rotor at the vane edges is much larger than that of the shaft diameter, the outside diameter typically being 46" and the shaft diameter typically 2.375". The rear end of the swimming tank has for substantially the entire depth a transverse vane pump with a semicircular closed shroud. The rotor and shroud are completely submerged in water to prevent the induction of air and noisy churning turbulence that would accompany such induction. For river-like swimming comfort it is desirable to minimize noise and turbulence.

As the vaned rotor rotates, it pushes water over its entire length, nearly equal to the tank width, between the vane chambers and shroud and into the lower channel 12 formed between the plastic false bottom and the tank bottom. The vaned rotor expels the water tangentially directly into the lower channel 12, or preferably into a tapering transition zone as shown. The transition zone is not absolutely required but tends to reduce turbulence in the water above the floor because water that might otherwise be thrust upward against the flow in the upper or swim portion of the tank is captured by the transition zone and directed to the lower channel. The false bottom or transition zone bottom edge is preferably placed in close proximity to the vanes as a control point for flow down the lower channel.

Lower channel 12 is typically 9–10 inches deep and may include a longitudinal septum to divide it into parallel rectangular channels that provide increased structural strength. These long parallel channels may further function as flow straighteners and turbulence dampers to coact with the transverse vane pump in delivering fluid exiting from the pump in large volumes at the front or delivery end of the tank at relatively low pressure. Thus, fluid inducted at the entrance to the vane pump at the top is delivered at low pressure down the enclosed lower channel 12 where it is forced to gradually reverse direction 180° and undergo a velocity reduction at the top front of the tank through the exit mouth, of height typically 5–8" higher than the lower channel depth. Alternatively, the exit mouth could be of height the same as the lower channel depth and deliver fluid to the top of the tank at greater velocity over a lesser depth.

Water at fairly high velocity, typically between 3–6 knots or more, is thereby forced into the swimming section at the top of the tank across the entire width substantially uniformly with negligible velocity gradient along the width and with little noise or turbulence. This stream extends downward from the top for 15–18" typically. The water traveling rearward in the open channel loses several knots in velocity vertically in the process of merging into the deeper open channel, typically 48" of the swim tank, but the flow is steadily maintained by the vane pump as it continuously draws water arriving at the rear end of the tank.

The relatively high water velocity in the lower channel 12 tends to keep this channel naturally clean so that it may be permanently enclosed without access. The limited depth of the lower channel allows continuous flow without wasting appreciable tank depth.

It may be desirable to create wave action to provide a swimmer with additional challenge and fun. This may be accomplished by placing a barrier plate extending several inches into the stream across the entire width of the tank at the upper portion of the exit mouth. The exiting water is then forced to suddenly flow downward and under the barrier plate and will tend to immediately rise to the surface in the form of a wavelet of adjustable height. This effect may be created without the barrier blade at high velocities typically greater than two knots or more arising from natural surface agitation resulting from water delivery to the open channel.

The use of a variable speed induction motor saves considerable energy because the required power increases with vane speed. The induction motor delivers and draws power only at the levels required for a particular rate of flow.

The following table sets forth the relationship between input current, motor current, the speed dial setting and current flow.

| Input Amps. | Motor Amps. | Speed Dial Set. | Flow (knots) |
|---|---|---|---|
| 2 | 4.5 | 20 | 0 |
| 3 | 8.5 | 30 | .58 |
| 4 | 9.75 | 40 | .93 |
| 6 | 10.5 | 50 | 1.12 |
| 8 | 11.5 | 60 | 1.25 |
| 11 | 13.5 | 70 | 1.55 |
| 19.5 | 15 | 80 | 1.8 |
| 25 | 17 | 90 | 2 |

Figure 4:
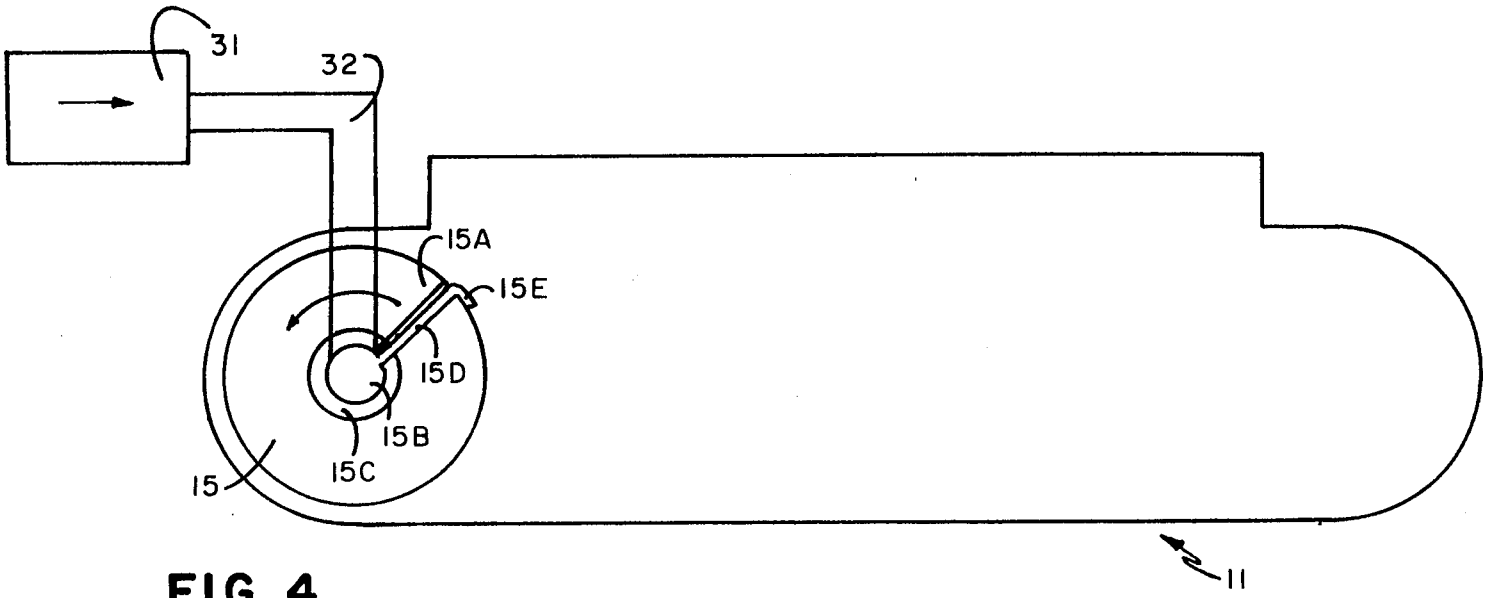
FIGS. 4 and 5 are diagrammatic side and partial top views of an embodiment of the invention with the vaned rotor driven by jets.
Figure 5:
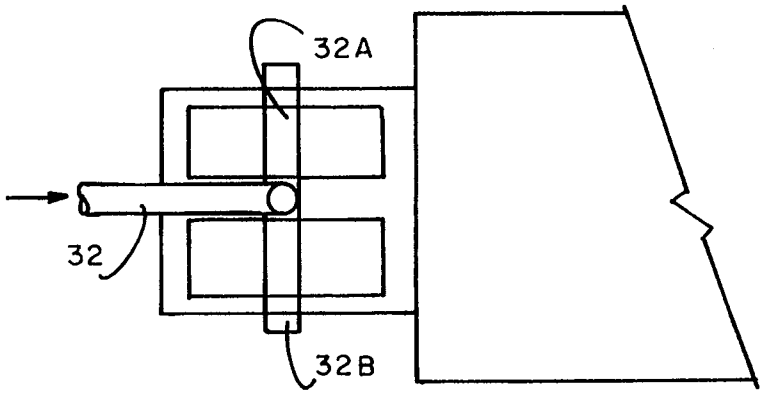

Referring to FIGS. 4 and 5, there are shown diagrammatic side and partial top views of the embodiment of the invention in which the vaned rotor is driven by jets. Vaned rotor 15 is mounted on a stationary hollow shaft 15B surrounded by a sealed manifold and bearing 15C. A pump 31 provides fluid under pressure, typically water, through pipe 32 to hollow shaft 15B formed with ports that communicate through manifold 15C with radial tubes, such as 15D connected to a nozzle such as 15E at the end of a vane, such as 15A. FIG. 5 shows a diagrammatic partial top view of feeding shaft 15B through pipe 32 that branches into a U-shaped pipe assembly having branches 32A and 32B for feeding the ends of hollow shaft 15B.

The fluid, typically water from the tank, may be delivered by one or two large pipes to the stationary hollow shaft coming in from above to simplify tank burial, or from either or both ends of hollow shaft 15B. The fluid is delivered through ports in hollow shaft 15B to manifolds 15C rotating with vaned rotor 15 and sealed to the shaft. These seals could leak somewhat without concern because they are in the tank water. The wheel manifolds may also function as bearings and by means of PVC tubing, such as 15D, connected to the nozzles, such as 15E mounted to the vanes, such as 15A, at their periphery.

The invention not only has value for recreational and exercising purposes, but may also be used for therapeutic purposes. A physician or therapist could easily observe and aid a patient while immersed partially in the tank from a point outside the tank while standing on a platform.

The patient might execute simple body motions in opposition to the current at a speed controlled by the therapist. Additionally, the patient could walk or push objects of varying fluid resistance through the flow stream to increase the load on muscles and skeletal structure while immersed in a relatively low velocity current that would create relatively little discomfort. Furthermore, the moving water could be warmed and/or salted, to any degree desired for deep muscle therapy, all conducted while the body is under very little load because of the buoyancy effects that could be further enhanced by flotation devices attached to the patient.

While the speed of current flow is preferably controlled by adjusting the vaned rotor speed, speed may also be adjusted by varying the effective cross sectional area of the flow channel between inlet and outlet. For example, a vane may be introduced into this channel with controllable penetration. Angularly adjustable venetian-blind-like vanes may be interposed, preferably at the outlet. Other means for selectively introducing flow impedance into the stream may be used.

A number of exemplary dimensions have been set forth above. The length of the swim channel between baffle 17 and outlet 14 is typically substantially 12 feet. The curvature of the outer wall of the curved transition portion at the front is typically 23.75" radius and that of the inner wall substantially 11.5" radius to form a substantially semicircular cylinder having an annular passage of substantially 180°. The top of shroud 18 is typically 10" below the top of tank 11.

The specific embodiments described herein are by way of example only. Numerous variations may be practiced by those skilled in the art. For example, the driving means might comprise a row of pumps at either the front or rear of the tank, or in between, with outlets spaced across the width so as to maintain the velocity gradient substantially zero along the width of the tank in the stream at the top of the tank. Numerous other variations will be suggested to those skilled in the art. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Flow controlling apparatus comprising, tank means having width, length and height dimensions for supporting fluid, channel defining means in said tank means for defining upper and lower channels therein for allowing fluid flow in upper and lower opposed directions along said length dimension, drive means extending across substantially the entire width of said tank means for propelling said fluid through said upper and lower channels with substantially uniform velocity of said fluid along said length dimension across substantially the entire width of said tank means at the top of said tank means, wherein said drive means comprises a vaned rotor with vanes angularly spaced about the rotor axis rotatably supported in said tank means at one end thereof, said rotor axis being substantially parallel to the width dimension of said tank means and the length of each of said vanes corresponding substantially to the width of said tank means, shroud means of substantially semicircular cross section surrounding the outside portion of said vaned rotor means and coacting therewith to form a vane pump with working clearance between said shroud means and the outside edges of said vanes, and entry deflector means angled upward from said lower channel toward said vaned rotor for capturing an escape plume from said vaned rotor and directing said escape plume along said lower channel.

2. Flow controlling apparatus comprising, tank means having width, length and height dimensions for supporting fluid, channel defining means in said tank means for defining upper and lower channels therein for allowing fluid flow in upper and lower opposed directions along said length dimension, and drive means extending across substantially the entire width of said tank means for propelling said fluid through said upper and lower channels with substantially uniform velocity of said fluid along said length dimension across substantially the entire width of said tank means at the top of said tank means, wherein said drive means comprises a vaned rotor with vanes angularly spaced about the rotor axis rotatably supported in said tank means at one end thereof, said rotor axis being substantially parallel to the width dimension of said tank means and the length of each of said vanes corresponding substantially to the width of said tank means.

3. Flow controlling apparatus in accordance with claim 2 and further comprising, means defining a transition channel inter-coupling said upper and lower channels and characterized by curved longitudinal cross section with a substantially rectangular opening at the top.

4. Flow controlling apparatus in accordance with claim 3 wherein the top of said rectangular opening is below the top of said tank means so that when said tank means is filled with fluid, said fluid covers said rectangular opening.

5. Flow controlling apparatus in accordance with claim 2 and further comprising, shroud means of substantially semicircular cross section surrounding the outside portion of said vaned rotor means and coacting therewith to form a vane pump with working clearance between said shroud means and the outside edges of said vanes.

6. Flow controlling apparatus in accordance with claim 5 and further comprising, baffle means at the end of said upper channel adjacent to said rotor for controlling backup wave severity and helping prevent swimmers from engaging the vanes while moving.

7. Flow controlling apparatus in accordance with claim 6 wherein said baffle means comprises means for open shrouding said rotor.

8. Flow controlling apparatus in accordance with claim 2 wherein said drive means further comprises, an induction motor mechanically coupled to said vaned rotor, inverter means for converting input energy into A-C energy of controlled frequency, and means for coupling said energy of controlled frequency to said induction motor to control the speed of rotation of said vaned rotor.

9. Flow controlling apparatus in accordance with claim 2 and further comprising, means defining a transition channel inter-coupling said upper and lower channels and characterized by curved longitudinal cross section with a substantially rectangular opening at the top, the height of said rectangular opening being greater than the depth of said lower channel.

10. Flow controlling apparatus in accordance with claim 9 wherein the top of said rectangular opening is below the top of said tank means so that when said tank means is filled with fluid, said fluid covers said rectangular opening.

11. Flow controlling apparatus in accordance with claim 2 and further comprising, baffle means at the end of said upper channel adjacent to said rotor for controlling backup wave severity and helping prevent swimmers from engaging the vanes while moving.

12. Flow controlling apparatus in accordance with claim 11 wherein said baffle means comprises means for open shrouding said rotor.

13. Flow controlling apparatus in accordance with claim 2 wherein said drive means further comprises, pump means for providing fluid under pressure, said vanes including nozzle means for ejecting fluid under pressure in a direction tangential to the outer perimeter of said vanes, and means for coupling fluid under pressure from said pump means to said nozzle means to cause rotation of said vaned rotor.

14. Flow controlling apparatus comprising, tank means having width, length and height dimensions for supporting fluid, channel defining means in said tank means for defining upper and lower channels therein for allowing fluid flow in upper and lower opposed directions along said length dimension, drive means extending across substantially the entire width of said tank means for propelling said fluid through said upper and lower channels with substantially uniform velocity of said fluid along said length dimension across substantially the entire width of said tank means at the top of said tank means, wherein said drive means comprises a vaned rotor with vanes angularly spaced about the rotor axis rotatably supported in said tank means at one end thereof, said rotor axis being substantially parallel to the width dimension of said tank means and the length of each of said vanes corresponding substantially to the width of said tank means, wherein the length of said vanes corresponds substantially to the width of said tank means, and shroud means of substantially semicircular cross section surrounding the outside portion of said vaned rotor means and coacting therewith to form a vane pump with working clearance between said shroud means and the outside edges of said vanes, the diameter of said vaned rotor being slightly less than the depth of said tank means.

15. Flow controlling apparatus in accordance with claim 14 and further comprising entry deflector means angled upward from said lower channel toward said vaned rotor for capturing an escape plume from said vaned rotor and directing said escape plume along said lower channel.

16. Flow controlling apparatus comprising, tank means having width, length and height dimensions for supporting fluid, channel defining means in said tank means for defining upper and lower channels therein for allowing fluid flow in upper and lower opposed directions along said length dimension, drive means extending across substantially the entire width of said tank means for propelling said fluid through said upper and lower channels with substantially uniform velocity of said fluid along said length dimension across substantially the entire width of said tank means at the top of said tank means, wherein said drive means comprises a vaned rotor with vanes angularly spaced about the rotor axis rotatably supported in said tank means at one end thereof, said rotor axis being substantially parallel to the width dimension of said tank means and the length of each of said vanes corresponding substantially to the width of said tank means, and entry deflector means angled upward from said lower channel toward said vaned rotor for capturing an escape plume from said vaned rotor and directing said escape plume along said lower channel.

* * * * *